US011168547B2

(12) United States Patent
Cote

(10) Patent No.: US 11,168,547 B2
(45) Date of Patent: Nov. 9, 2021

(54) PROGRESSIVE CAVITY PUMP AND METHODS FOR USING THE SAME

(71) Applicant: Artificial Lift Production International Corp., Cochrane (CA)

(72) Inventor: Brennon Leigh Cote, Cochrane (CA)

(73) Assignee: Artificial Lift Production International Corp., Cochrane (CA)

( * ) Notice: Subject to any disclaimer, the term of this patent is extended or adjusted under 35 U.S.C. 154(b) by 0 days.

(21) Appl. No.: 16/816,570

(22) Filed: Mar. 12, 2020

(65) Prior Publication Data

US 2020/0291757 A1 Sep. 17, 2020

Related U.S. Application Data

(60) Provisional application No. 62/819,137, filed on Mar. 15, 2019.

(51) Int. Cl.

| | |
|---|---|
| ***E21B 43/12*** | (2006.01) |
| ***E21B 34/08*** | (2006.01) |
| ***E21B 23/04*** | (2006.01) |
| *F04C 13/00* | (2006.01) |

(52) U.S. Cl.

CPC ..... *E21B 43/121* (2013.01); *E21B 23/0419* (2020.05); *E21B 34/08* (2013.01); *E21B 43/126* (2013.01); *E21B 43/13* (2020.05); *F04C 13/008* (2013.01); *F04C 2280/02* (2013.01)

(58) Field of Classification Search

CPC .... E21B 43/126; E21B 43/13; E21B 23/0419; E21B 43/121

See application file for complete search history.

(56) References Cited

U.S. PATENT DOCUMENTS

| | | | | |
|---|---|---|---|---|
| 6,604,910 | B1 * | 8/2003 | Zupanick | F04C 14/08 417/36 |
| 6,907,925 | B2 | 6/2005 | Cote | |
| 7,290,608 | B2 | 11/2007 | Wittrisch | |
| 2011/0259438 | A1 * | 10/2011 | Osborne | F16K 17/0406 137/115.13 |
| 2016/0369788 | A1 * | 12/2016 | Brown | E21B 43/128 |
| 2017/0152724 | A1 * | 6/2017 | Cote | E21B 43/121 |
| 2018/0266221 | A1 * | 9/2018 | Cote | F04B 47/00 |

FOREIGN PATENT DOCUMENTS

| | | | |
|---|---|---|---|
| CA | 2510240 | A1 | 12/2005 |

* cited by examiner

*Primary Examiner* — Cathleen R Hutchins
(74) *Attorney, Agent, or Firm* — Field LLP

(57) ABSTRACT

A device is provided for pumping fluid from a wellbore up to surface. The device includes a stator unit, a rotor unit run within the stator unit on a rod string, the rotor unit and the stator unit engaging with one another to form an annular space therebetween for passage of fluid. An upstream check valve on the rod string uphole of the rotor unit is moveable from an open position in which fluid is passable through the annular space, and a closed position in which fluid passage through the annular space is prevented. A hollow rod section extends through the rod string in fluid communication with the annular space both downstream and upstream of the upstream check valve, for entry of fluid into a downhole end of the hollow rod section, passage of fluid upstream therefrom and exit of fluids from an uphole end of the hollow rod section, back into the annular space. A method is further provided for pumping fluid from a wellbore after shutdown.

16 Claims, 2 Drawing Sheets

PROGRESSIVE CAVITY PUMP AND METHODS FOR USING THE SAME

FIELD

The present disclosure relates to improvements to progressive cavity pumps and methods for pumping downhole fluids to surface.

BACKGROUND

The subject of the present disclosure relates generally to downhole wellbore systems used for pumping hydrocarbon products to surface. Such systems are often called artificial lift systems. The systems typically use a progressive cavity (PC) pump to pump liquid hydrocarbon from underground formations in a cased wellbore up to surface. The stator portion of the PC pump is typically run down on a tubing string and the rotor portion of the PC pump is run into the stator on a rod string. Movement of the rotor within the stator creates a series of annular spaces through which fluid travels as the PC pump operates. Fluid is pumped from a lower inlet between the rotor and stator up through the annular spaces to surface.

In wells with high solids content, a common issue is that of build-up of solids that can block various sections of the PC pump, thereby preventing the pump from pumping.

To wash out debris accumulating at the pump inlet end, hollow rotors have been used, see for example U.S. Pat. No. 6,907,925 to Cote. This patent proposes a portion of the rotor being hollow with a central bore extending from a primary orifice near the pump primary inlet to a secondary orifice spaced away from the primary pump inlet. A means is provided for diverting a portion of the fluids being pumped into the secondary orifice and diverting down through the bore and out the primary orifice to thereby wash away accumulated solids from the primary pump inlet.

Other devices, such as that taught in CA 2,510,240 teach an external circulation conduit with a venture style circulation nozzle for taking a side stream of fluid and re-direct it at the pump intake. U.S. Pat. No. 7,290,608 to Wittrisch, teaches a separate tube or line connected to a secondary fluid source and a pump, said separate line running through the rotor to pump a secondary fluid to the PC pump inlet.

While these prior art references focus on means to clear an inlet end of the PC pump, a need still exists for devices and methods for keeping the annulus of the PC pump system free from debris and to encourage circulation of fluids.

SUMMARY

A device is provided for pumping fluid from a wellbore up to surface. The device comprises a stator unit; a rotor unit run within the stator unit on a rod string, the rotor unit and the stator unit engaging with one another to form an annular space therebetween for passage of fluid; an upstream check valve on the rod string uphole of the rotor unit, said upstream check valve moveable from an open position in which fluid is passable through the annular space, and a closed position in which fluid passage through the annular space is prevented; and a hollow rod section extending through the rod string in fluid communication with the annular space both downstream and upstream of the upstream check valve, for entry of fluid into a downhole end of the hollow rod section, passage of fluid upstream therefrom and exit of fluids from an uphole end of the hollow rod section, back into the annular space.

A method is further provided for pumping fluid from a wellbore after shutdown. The method comprises the steps of providing a PC pump having a stator deployed in the wellbore on a tubing string and a rotor deployed on a rod string into the wellbore and into the stator; said rotor and stator defining an annular space therebetween for passage of fluid therein; shifting an upstream check valve on the rod string uphole of the rotor unit, from a closed position in which fluid passage through the annular space is prevented to an open position in which fluid is passable through the annular space; pumping fluid into a hollow section of the rod string, from a first end downhole of the upstream check valve to a second end, uphole of the upstream check valve; and allowing fluid to exit the hollow section of the rod string.

It is to be understood that other aspects of the present invention will become readily apparent to those skilled in the art from the following detailed description, wherein various embodiments of the invention are shown and described by way of illustration. As will be realized, the invention is capable of other and different embodiments and its several details are capable of modification in various other respects, all without departing from the spirit and scope of the present invention. Accordingly the drawings and detailed description are to be regarded as illustrative in nature and not as restrictive.

BRIEF DESCRIPTION OF THE DRAWINGS

A further, detailed, description of the invention, briefly described above, will follow by reference to the following drawings of specific embodiments of the invention. The drawings depict only typical embodiments of the invention and are therefore not to be considered limiting of its scope. In the drawings.

The drawings are not necessarily to scale and in some instances proportions may have been exaggerated in order to more clearly depict certain features.

DETAILED DESCRIPTION

The description that follows and the embodiments described therein are provided by way of illustration of an example, or examples, of particular embodiments of the principles of various aspects of the present invention. These examples are provided for the purposes of explanation, and not of limitation, of those principles and of the invention in its various aspects.

The present disclosure relates to a device and methods for reducing debris accumulation on parts of PC pumps. Furthermore the present devices and methods for encouraging agitation and circulation at a PC pump upstream end, to further reduce debris build up and blockage at the PC pump upstream end.

Figure 1B:
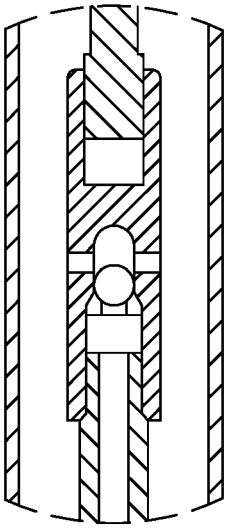
FIG. 1*b* is a detailed cross sectional elevation view, taken from FIG. 1, of one example of a lower ported coupling of the present invention.
Figure 1A:
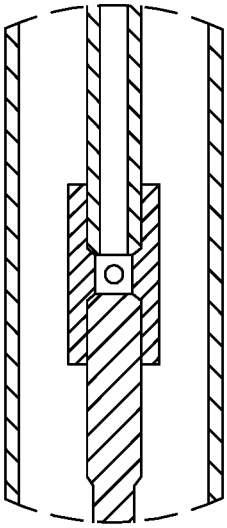
FIG. 1*a* is a detailed cross sectional elevation view, taken from FIG. 1, of one example of an upper ported coupling and upper coupling check valve of the present invention.
Figure 1:
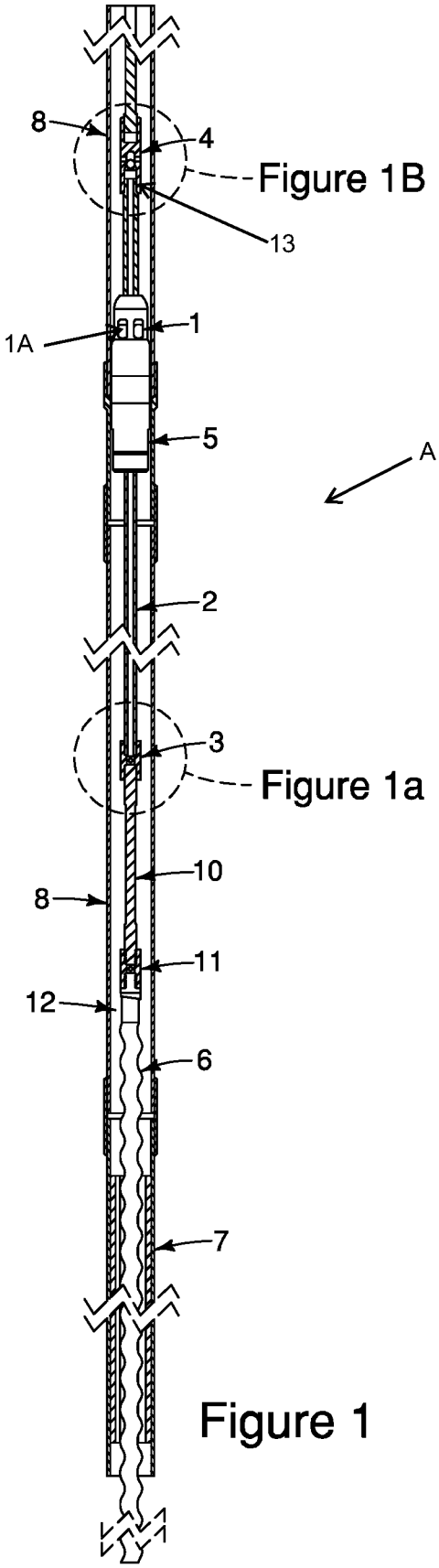
FIG. 1 is a partial cross sectional elevation view of one example of a PC pump system of the present invention, illustrating a tubing string carrying the stator, a rod string carrying the rotor and associate further elements.
Figure 2:
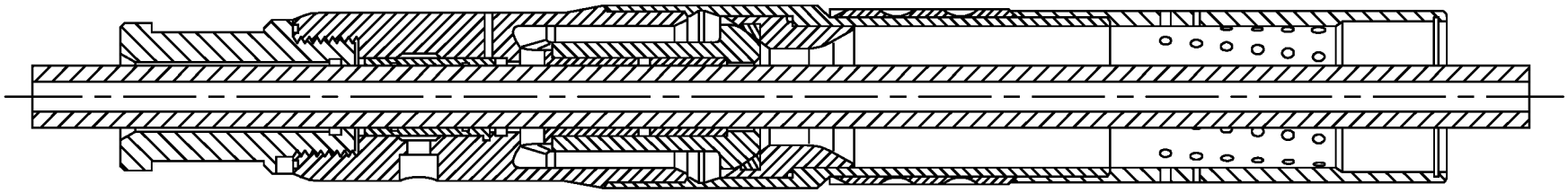
FIG. 2 is a cross sectional elevation view of one example of an upstream check valve used in conjunction with the present invention.

With reference to the figures, FIG. 1 shows a PC pump A, comprising a stator 7 run on a tubing string 8 and a rotor 6 run through the tubing string 8 and into the stator 7 on a rod string 10, also called a sucker rod string 10. Preferably, the sucker rod 10 is connected to the rotor 6 via a sucker rod coupling 11. Between an outer surface of the rotor 6 and an inner surface of the stator 7 is defined an annular space 12 through which wellbore fluid is produced to surface.

An upstream check valve assembly 1, seated on a seating nipple 5 of the rod string 10, serves to allow closing of the annular space 12 during a shutdown event. Upstream check valves can be used on PC pump wells that tend to experience long backspin. Backspin is the term used to describe a release of stored energy in the PC pump when the PC pump system comes to a stop.

However, while required for backspin mitigation, upstream check valves tend to not to work well in high-solids content formations where produced fluids from the well can contain up to 10% solids, commonly sand. The upstream check valves serve to close the annular space 12 downhole of the upstream check valve, to thereby reduce sand settlement and buildup on the rotor 6. However, sand in fluids uphole of the upstream check valve tend to settle onto the upstream check valve outlets 1A during shutdown, leading to blockage of the annular space 12 upstream of the upstream check valve, when the PC pump A is restarted. In many cases, depending on the depth of the well, anywhere from 30 ft to 40 ft of sand may accumulate above the upstream check valve during a shutdown.

The present upstream check valve 1 is an upstream check valve with a bypass, in which the sucker rod 10 extends through the upstream check valve 1.

The present sucker rod 10 comprises a hollow rod section 2 that is connected to the sucker rod 10 by a ported lower coupling 3 and runs uphole from the ported lower coupling 3, through the upstream check valve with bypass 1 and ending at a second, ported upper coupling 13 that is upstream of the upstream check valve 1. The hollow rod section 2 is preferably a polished hollow rod section 2.

In one embodiment, an upper coupling check valve 4 is installed just downhole of the ported upper coupling 13 on the hollow rod section 2. In other embodiments, the ported upper coupling 13 and the upper coupling check valve are formed as one single unit, namely a ported upper coupling check valve 4. In either case, the upper coupling check valve 4 is oriented to allow flow uphole through the hollow rod section 2 and out through the ported upper couplings 13 or out through the ports of the ported upper coupling check valve 4, but it does not allow flow downhole during a shutdown. During a shutdown, the upper coupling check valve 4 serves to block and prevent fluid bypass down through the hollow rod section and into the annular space downstream of the upstream check valve 1. At start up, when the PC pump is started up again, fluid flow overcomes the pressure needed to open the upper coupling check valve 4 and flows as described further herein.

During operation, fluid can be produced through the tubing 8, via annular space 12, as well as through the hollow rod 2. During a shut-down event, both the upstream check valve 1 and the coupling check valve 4 are closed, preventing the fluid in the tubing 8 from draining back downhole through the PC pump A or through the hollow rod section 2. In cases of produced fluid having high solids concentration, these solids can settle on top of the upstream check valve 1 while the system is shut down, and block the upstream check valve outlets 1A.

In one embodiment of the present system, in startup of the PC pump after a shutdown, production fluids can be forced into the lower ported coupling 3 up through the hollow rod 2, exiting through the upper ported coupling 13 at high velocity. In this embodiment, the upper ported coupling may be located closely upstream to the upstream check valve 1. The high velocity production fluid serves to agitate and thereby remove solids blocking the upstream check valve 1 outlets 1A, allowing it to open and resume normal production of fluids through the annular space 12 as well as through the hollow rod 2. Preferably ports of the upper ported coupling 13 are designed to achieve high velocity and sand suspension.

In some cases, such as formations with high sediments content, the build-up of sand or other solids on the upstream check valve can be significant enough that it is not possible to efficiently agitate and remove solids from the outlets 1A of the upstream check valve 1. In such cases, an alternative version of the present invention can be used in which the hollow rod 2 extends further up beyond the upstream check valve 1, and the upper ported coupling 3 and upper coupling check valve 13 can be located at a greater distance from the upstream check valve 1, in this way it is ensure that when the PC pump A is restarted, fluid can flow through the hollow rod 2 and exit the hollow rod at an uphole point that is above a height of solids content in the annular space 12 between the rod string 10 and the tubing string 8. This serves to extend the length of time that the particular PC pump system can be run which in turn extends the production life of the well.

In both embodiments described above it would be understood by a person of skill in the art the both the upper ported coupling 3 and the upper coupling check valve 13 are preferably sized to meet flow requirements of the well, considering the volume to be pumped, depth of the well, viscosity of the fluid being pumped, etc.

In a preferred embodiment, as a backup or emergency release system, the upstream check valve 1 can be made at least in part from a shearable material. In such embodiment, should circulation of fluids through the hollow sucker rod 2 and exit of said fluids from the upper ported coupling 13 fail to unblock the outlet ports 1A of the upstream check valve 1, then the rod string 10 can be pulled uphole and in this case the lower ported coupling 3 serves as a shoulder to engage within the top portion of the upstream check valve 1 and force the upstream check valve to disengage from seating nipple 5, thereby reopening the tubing 8 and stator 7 of the PC pump A. At that point, a new PC pump rod string and rotor can be deployed into the well to continue production.

In a further preferred embodiment, the sleeve coupling on the tubing around the upstream check valve can be Teflon and therefore easily sheared.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The invention claimed is:

1. A device for pumping fluid from a wellbore up to surface, said device comprising;

a. a stator unit;

b. a rotor unit run within the stator unit on a rod string, the rotor unit and the stator unit engaging with one another to form an annular space therebetween for passage of fluid;

c. an upstream check valve on the rod string uphole of the rotor unit, said upstream check valve moveable from an open position in which fluid is passable through the annular space, and a closed position in which fluid passage through the annular space is prevented; and d. a hollow rod section of the rod string in fluid communication with the annular space both downstream and upstream of the upstream check valve, for entry of fluid into a downhole end of the hollow rod section, passage of fluid upstream therefrom and exit of fluids under pressure and at high velocity from an uphole end of the hollow rod section, back into the annular space.

2. The device of claim 1, wherein the uphole end of the hollow rod section is located at a position selected from the group consisting of: closely upstream to the upstream check valve such that fluid exiting the hollow rod section serves to agitate and remove solids blocking the upstream check valve; and distantly from the upstream check valve such that fluid exiting the hollow rod is uphole of solids accumulation uphole of the upstream check valve.

3. The device of claim 2, wherein the hollow rod section is closeable to prevent bypass of fluids from an upstream end of the hollow rod to a downstream end of the hollow rod when the upstream check valve is in a closed position.

4. The device of claim 3, wherein the hollow rod section is closeable by means of an upper coupling check valve located on the rod string at an uphole end of the hollow rod section.

5. The device of claim 4, wherein the hollow rod section of the rod string comprises a lower ported coupling for entry of fluids into the hollow rod section, and an upper ported coupling, closeable by the upper coupling check valve, for exit of fluids from the hollow rod section.

6. The device of claim 5, wherein the upper ported coupling and the upper coupling check valve are formed as a single unit.

7. The device of claim 5, wherein the upper ported coupling is configured to achieve high fluid velocity as fluid exits the hollow rod section.

8. The device of claim 1, wherein the hollow rod section is a polished hollow rod section.

9. The device of claim 1, wherein the upstream check valve comprises valve outlets through which fluid is passable through the annular space when the valve is in an opened position.

10. The device of claim 1 wherein the upstream check valve is removably installed on the rod string by means of a seating nipple, wherein the upstream check valve is shearable from the seating nipple to remove the upstream check valve and to raise the rod string to surface.

11. A method for pumping fluid from a wellbore after shutdown, said method comprising the steps of:

a. providing a progressive cavity pump having a stator deployed in the wellbore on a tubing string and a rotor deployed on a rod string into the wellbore and into the stator; said rotor and stator defining an annular space therebetween for passage of fluid therein;

b. shifting an upstream check valve on the rod string uphole of the rotor unit, from a closed position in which fluid passage through the annular space is prevented to an open position in which fluid is passable through the annular space;

c. pumping fluid into a hollow section of the rod string, from a first end downhole of the upstream check valve to a second end, uphole of the upstream check valve; and d. allowing fluid to exit the hollow section of the rod string.

12. The method of claim 11, wherein the second end of the hollow rod section is located closely upstream to the upstream check valve and wherein fluid exiting the hollow rod section serves to agitate and remove solids blocking the upstream check valve.

13. The method of claim 11, wherein the uphole end of the hollow rod section is located distantly from the upstream check valve and wherein fluid exiting the hollow rod section bypasses solids accumulation uphole of the upstream check valve.

14. The method of claim 12, further comprising opening the hollow rod section by force of fluid pumped into the hollow rod section.

15. The method of claim 14, wherein opening the hollow rod section comprises opening an upper coupling check valve located at an uphole end of the hollow rod section.

16. The method of claim 11, further comprising removing the upstream check valve and the rod string from the tubing by shearing the upstream check valve from a seating nipple and raising the rod string to surface.

* * * * *